US006410153B1

(12) United States Patent
Broomfield et al.

(10) Patent No.: US 6,410,153 B1
(45) Date of Patent: Jun. 25, 2002

(54) NICKEL BASED SUPERALLOY

(75) Inventors: Robert W Broomfield, Bristol; Colin N Jones, Nottingham, both of (GB)

(73) Assignee: Rolls-Royce plc, London (GB)

( * ) Notice: Subject to any disclaimer, the term of this patent is extended or adjusted under 35 U.S.C. 154(b) by 0 days.

(21) Appl. No.: 09/504,034

(22) Filed: Feb. 14, 2000

(30) Foreign Application Priority Data

Feb. 22, 1999 (GB) ..... 9903988

(51) Int. Cl.[7] ..... B32B 15/04; C22C 19/05

(52) U.S. Cl. ..... 428/469; 428/621; 428/632; 428/680; 416/241 R; 420/442; 420/445; 420/460

(58) Field of Search ..... 428/621, 632, 428/633, 634, 668, 652, 670, 678, 680; 416/241 R, 241 B; 420/442, 445, 460, 466

(56) References Cited

U.S. PATENT DOCUMENTS

| | | | | |
|---|---|---|---|---|
| 4,169,742 A | | 10/1979 | Wukusick | |
| 4,388,124 A | | 6/1983 | Henry | |
| 4,849,030 A | * | 7/1989 | Darolia et al. | 148/3 |
| 5,270,123 A | | 12/1993 | Walston | |
| 5,366,695 A | | 11/1994 | Erickson | |
| 5,470,371 A | | 11/1995 | Darolia | |
| 5,763,107 A | * | 6/1998 | Rickerby et al. | |
| 5,783,318 A | * | 7/1998 | Biondi et al. | 428/680 |
| 5,891,267 A | * | 4/1999 | Schaeffer et al. | 148/206 |
| 6,001,492 A | * | 12/1999 | Jackson et al. | |
| 6,051,083 A | * | 4/2000 | Tamaki et al. | 148/410 |
| 6,096,141 A | * | 8/2000 | King et al. | 148/429 |

FOREIGN PATENT DOCUMENTS

| | | |
|---|---|---|
| EP | 0 155 827 A | 9/1985 |
| EP | 0208645 A2 A | 1/1987 |
| EP | 0 687 741 A | 12/1995 |
| EP | 0 848 071 A | 6/1998 |
| GB | 1562082 SP | 3/1980 |
| WO | PCT/CH97/00210 A | 5/1997 |

* cited by examiner

*Primary Examiner*—Deborah Jones
*Assistant Examiner*—Jennifer C. McNeil
(74) *Attorney, Agent, or Firm*—W. Warren Taltavull; Manelli, Denison & Selter PLLC

(57) ABSTRACT

A nickel based single crystal superalloy comprising 6–11 wt % cobalt, 4.7–5.7 wt % chromium, 2.4–3.0 wt % molybdenum, 3.0–3.8 wt % tungsten, 3.0–3.8 wt % rhenium, 5.5–7.0 wt % aluminium, 5.0–6.0 wt % tantalum, 0.5–1.0 wt % niobium, 0–0.2 wt % hafnium, 0–150 ppm carbon, 0–100 ppm yttrium, 0–100 ppm lanthanum, 0–5 ppm sulphur and the balance nickel plus incidental impurities. The nickel based single crystal superalloy is suitable for use as a gas turbine engine turbine blade or turbine vane. It is of particular use on cooled turbine blades and turbine vanes which have ceramic thermal barrier coatings, because the superalloy is compatible with the ceramic thermal barrier coating to minimize spalling. The superalloy has lower density than other second generation single crystal superalloys but similar creep strength and oxidation resistance.

15 Claims, 2 Drawing Sheets

NICKEL BASED SUPERALLOY

FIELD OF THE INVENTION

The present invention relates to nickel based superalloys, particularly to nickel based single crystal superalloys, or particularly nickel based single crystal superalloys for use as turbine blades, turbine vanes, turbine seals and combustor components of gas turbine engines, but they may be used in internal combustion engines etc.

BACKGROUND OF THE INVENTION

Nickel based single crystal superalloys have been developed to provide improved high temperature mechanical properties such as creep strength. However, there are many other important properties which need to be optimized to a high level in order for a nickel based single crystal superalloy to be acceptable for use in a gas turbine engine.

Other properties which need to be optimized are density, resistance to oxidation, resistance to corrosion, compatibility with protective coatings, heat treatment response and castability.

There are three generations of nickel based single crystal superalloys which differ by the amount of the key element rhenium. The first generation of nickel based single crystal superalloys contained no rhenium, examples of these are disclosed in published UK patent application nos. GB2039296A, GB2073774A, GB2105369A, GB2106138A and GB2151659A. The first generation of nickel based single crystal superalloys have densities of 7.9 to 8.7 gm per $cm^3$. The second generation of nickel based single crystal superalloys contained about 3 wt % rhenium, examples of these are disclosed in published European patent application nos. EP0155827A and EP0208645A. The second generation of nickel based single crystal superalloys have densities of 8.7 to 8.9 gm cm 3. The second generation of nickel based single crystal superalloys have a benefit in creep strength capability of about 30° C. over the first generation of nickel based single crystal superalloys. The third generation of nickel based single crystal superalloys contained about 6 wt % rhenium, examples of these are disclosed in U.S. Pat. No. 5,366,695 and U.S. Pat. No. 5,270,123 and published European patent application no. EP0848071A. The third generation of nickel based single crystal superalloys have densities of 8.9 to 9.1 gm per cm 3. The third generation of nickel based single crystal superalloys have a benefit in creep strength capability of about 30° C. over the second generation of nickel based single crystal superalloys.

Thus it is seen that the increase in creep strength is to the detriment of the density and the cost of the superalloy. An increase in density of the turbine blades and turbine vanes makes the gas turbine engine heavier and also results in a requirement to make the turbine rotor disc stronger to carry the heavier turbine blades, which also results in an increase in the weight of the turbine rotor disc.

The turbine blades requiring the greatest creep strength are usually those in the first stage of uncooled turbine blades, and for these turbine blades a third generation nickel based single crystal superalloy is used. However, for turbine blades and turbine vanes which are cooled the requirements are different. The creep strength requirement is lower and hence creep properties similar to the second generation nickel based single crystal superalloy are 25 sufficient. It is often the case that these cooled turbine blades and turbine vanes are protected by a ceramic thermal barrier coating. A major concern with a ceramic thermal barrier coating is that the ceramic thermal barrier coating will spall prematurely during engine service. The adherence of a ceramic thermal barrier coating is influenced by many factors, but a major factor is the composition of the superalloy substrate on which the ceramic thermal barrier coating is deposited.

The present invention seeks to provide a novel nickel based single crystal superalloy which has creep properties and high temperature oxidation resistance similar to a second generation nickel based single crystal superalloy but has reduced density compared to a second generation nickel based single crystal superalloy and better compatibility with a ceramic thermal barrier coating than a second generation nickel based single crystal superalloy.

Accordingly, the present invention provides a nickel based single crystal superalloy comprising 3–11 wt % cobalt, 4.7–5.7 wt % chromium, 2.4–3.0 wt % molybdenum, 3.0–3.8 wt % tungsten, 3.0–3.8 wt % rhenium, 5.5–7.0 wt % aluminum, 5.0–6.0 wt % tantalum, 0.5–1.0 wt % niobium, 0–0.2 wt % hafnium, 0–150 ppm carbon, 0–100 ppm yttrium, 0–100 ppm lanthanum, 0–5 ppm sulfur and the balance nickel plus incidental impurities.

The nickel based single crystal superalloy may comprise 9–11 wt % cobalt, 5.1–5.4 wt % chromium, 2.6–2.9 wt % molybdenum, 3.2–3.5 wt % tungsten, 3.2–3.5 wt % rhenium, 6.05–6.3 wt % aluminum, 5.4–5.7 wt % tantalum, 0.7–0.9 wt % niobium, 0.07–0.12 wt % hafnium, 50–150 ppm carbon, 0–100 ppm yttrium, 0–100 ppm, lanthanum, 0–5 ppm sulfur and the balance nickel plus incidental impurities.

Preferably the nickel based single crystal superalloy comprises 3–5 wt % cobalt, 5.1–5.4 wt % chromium, 2.6–2.9 wt % molybdenum, 3.2–3.5 wt % tungsten, 3.2–3.5 wt % rhenium, 6.05–6.3 wt % aluminum, 5.4–5.7 wt % tantalum, 0.7–0.9 wt % niobium, 0.07–0.12 wt % hafnium, 50–150 ppm carbon, 0–100 ppm yttrium, 0–100 ppm lanthanum, 0–5 ppm sulfur and the balance nickel plus incidental impurities.

The nickel based single crystal superalloy may comprise 4 wt % cobalt, 5.2 wt % chromium, 2.7 wt % molybdenum, 3.35 wt % tungsten, 3.4 wt % rhenium, 6.2 wt % aluminum, 5.5 wt % tantalum, 0.8 wt % niobium, 0.1 wt % hafnium, 0–100 ppm yttrium, 0–100 ppm lanthanum, 0–5 ppm sulfur and the balance nickel plus incidental impurities.

The nickel based single crystal superalloy may comprise 10 wt % cobalt, 5.2 wt % chromium, 2.7 wt % molybdenum, 3.35 wt % tungsten, 3.4 wt % rhenium, 6.2 wt % aluminum, 5.5 wt % tantalum, 0.8 wt % niobium, 0.1 wt % hafnium, 100 ppm carbon, 0–100 ppm yttrium, 0–100 ppm lanthanum, 0.5 ppm sulfur and the balance nickel plus incidental impurities.

The present invention also provides a cast single crystal nickel based superalloy article, the superalloy of the article comprising 3–11 wt % cobalt, 4.7–5.7 wt % chromium, 2.4–3.0 wt % molybdenum, 3.0–3.8 wt % tungsten, 3.0–3.8 wt % rhenium, 5.5–7.0 wt % aluminum, 5.0–6.0 wt % tantalum, 0.5–1.0 wt % niobium, 0–0.2 wt % hafnium, 0–150 ppm carbon, 0–100 ppm yttrium, 0–100 ppm lanthanum, 0–5 ppm sulfur and the balance nickel plus incidental impurities.

The cast single crystal nickel based superalloy article may comprise 9–11 wt % cobalt, 5.1–5.4 wt % chromium, 2.6–2.9 wt % molybdenum, 3.2–3.5 wt % tungsten, 3.2–3.5 wt % rhenium, 6.05–6.3 wt % aluminum, 5.4–5.7 wt % tantalum, 0.7–0.9 wt % niobium, 0.07–0.12 wt % hafnium, 50–150 ppm carbon, 0–100 ppm yttrium, 0–100 P.P.S. lanthanum, 0–5 ppm sulfur and the balance nickel plus incidental impurities.

Preferably the cast single crystal nickel based superalloy article comprises 3–5 wt % cobalt, 5.1–5.4 wt % chromium, 2.6–2.9 wt % molybdenum, 3.2–3.5 wt % tungsten, 3.2–3.5 wt % rhenium, 6.05–6.3 wt % aluminum, 5.4–5.7 wt % tantalum, 0.7–0.9 wt % niobium, 0.07–0.12 wt % hafnium, 50–150 ppm carbon, 0–100 ppm yttrium, 0–100 ppm lanthanum, 0–5 ppm sulfur and the balance nickel plus incidental impurities.

The cast single crystal nickel based superalloy article may comprise 4 wt % cobalt, 5.2 wt % chromium, 2.7 wt % molybdenum, 3.35 wt % tungsten, 3.4 wt % rhenium, 6.2 wt % aluminum, 5.5 wt % tantalum, 0.8 wt % niobium, 0.1 wt % hafnium, 0–100 ppm yttrium, 0–100 ppm lanthanum, 0–5 ppm sulfur and the balance nickel plus incidental impurities.

The cast single crystal nickel based superalloy article may comprise 10 wt % cobalt, 5.2 wt % chromium, 2.7 wt % molybdenum, 3.35 wt % tungsten, 3.4 wt % rhenium, 6.2 wt % aluminum, 5.5 wt % tantalum, 0.8 wt % niobium, 0.1 wt % hafnium, 100 ppm carbon, 0–100 ppm yttrium, 0–100 ppm lanthanum, 0.5 ppm sulfur and the balance nickel plus incidental impurities.

The cast single crystal nickel based superalloy article may comprise at least one internal passage for the flow of cooling fluid.

The cast single crystal nickel based superalloy article may comprise a bond coating on the article and a ceramic thermal barrier coating on the bond coating. The bond coating may comprise a layer of alumina. The bond coating may comprise a layer comprising platinum enriched gamma prime phase and platinum enriched gamma phase.

DETAILED DESCRIPTION OF THE INVENTION

A nickel based single crystal superalloy with second generation nickel based single crystal superalloy high temperature mechanical properties and high temperature oxidation resistance but which has compatibility with ceramic thermal barrier coatings, has lower density, has corrosion resistance, a suitable heat treatment window, resistance to freckling during casting and alloy cleanliness is required.

In order to achieve the second generation nickel based single crystal superalloy high temperature mechanical properties and high temperature oxidation resistance the rhenium level was set to at least 3 wt %.

A number of alloys were prepared as shown in Table 1, and Table 1 also includes known superalloys CMSX4 and CMSX10 of Cannon-Muskegon Corporation, of 2875 Lincoln Street, Muskegon, Mich., USA and described in European patent Application EP0155827A and U.S. Pat. No. 5,366,695 respectively. Superalloys 2071–2083 are not within the scope of the present invention whereas superalloys 2084–2087 are within the scope of the present invention.

It should be noted that superalloys 2074–2079 are a family based on superalloy 2072 and that superalloys 2080 2084 are a family and that superalloys 2085–2087 are a family based on superalloy 2084.

TABLE 1

| | Elements (wt %) | | | | | | | | | | |
|---|---|---|---|---|---|---|---|---|---|---|---|
| Alloy | Co | Cr | Mo | W | Re | Al | Ti | Ta | Nb | Hf | Ni |
| CMSX4 | 9.5 | 6.5 | 0.6 | 6.4 | 3.0 | 5.6 | 1.0 | 6.5 | 0 | 0.1 | Bal. |
| CMSX102.7 | 2.0 | 0.4 | 5.3 | 6.3 | 5.65 | 0.2 | 5.8 | 7.9 | 0.04 | Bal. | |
| 2071 | 9.5 | 6.6 | 4.5 | 0 | 2.8 | 5.6 | 1.3 | 7.3 | 0.3 | 0.1 | Bal. |
| 2072 | 4.0 | 6.0 | 3.3 | 1.9 | 3.0 | 6.2 | 0.4 | 5.95 | 0.8 | 0.1 | Bal. |
| 2073 | 4.0 | 6.0 | 2.8 | 2.3 | 3.0 | 6.1 | 0.3 | 5.5 | 1.4 | 0.1 | Bal. |
| 2074 | 4.0 | 7.0 | 3.3 | 1.9 | 3.0 | 6.2 | 0.4 | 5.95 | 0.8 | 0.1 | Bal. |
| 2075 | 4.0 | 5.0 | 3.3 | 1.9 | 3.0 | 6.2 | 0.4 | 5.95 | 0.8 | 0.1 | Bal. |
| 2076 | 6.5 | 7.0 | 3.3 | 1.9 | 3.0 | 6.2 | 0.4 | 5.95 | 0.8 | 0.1 | Bal. |
| 2077 | 4.0 | 6.0 | 3.3 | 1.9 | 3.0 | 6.35 | 0.4 | 5.95 | 1.0 | 0.1 | Bal. |
| 2078 | 4.0 | 6.0 | 3.3 | 1.9 | 3.0 | 6.2 | 0.4 | 5.0 | 0.8 | 0.1 | Bal. |
| 2079 | 4.0 | 6.0 | 3.3 | 1.9 | 3.0 | 6.2 | 0 | 5.95 | 0.8 | 0.1 | Bal. |
| 2080 | 4.0 | 6.0 | 3.3 | 1.95 | 3.0 | 6.3 | 0 | 6.0 | 0.8 | 0.1 | Bal. |
| 2081 | 4.0 | 6.0 | 2.9 | 2.75 | 3.0 | 6.2 | 0 | 5.55 | 1.0 | 0.1 | Bal. |
| 2082 | 4.0 | 6.0 | 2.5 | 3.95 | 3.0 | 6.2 | 0 | 4.9 | 1.0 | 0.1 | Bal. |
| 2083 | 4.0 | 5.3 | 2.5 | 3.95 | 3.0 | 6.3 | 0 | 5.1 | 1.0 | 0.1 | Bal. |
| 2084 | 4.0 | 5.2 | 2.7 | 3.35 | 3.4 | 6.2 | 0 | 5.5 | 0.8 | 0.1 | Bal. |
| 2085 | 7.0 | 5.2 | 2.7 | 3.35 | 3.4 | 6.2 | 0 | 5.5 | 0.8 | 0.1 | Bal. |
| 2086 | 10.0 | 5.2 | 2.7 | 3.35 | 3.4 | 6.2 | 0 | 5.5 | 0.8 | 0.1 | Bal. |
| 2087 | 10.0 | 5.2 | 2.7 | 3.35 | 3.4 | 6.2 | 0 | 5.5 | 0.8 | 0.1 | Bal.* |

Note
*Superalloy 2087 specifically comprises 100 ppm C.
Note that the superalloys 2071 to 2087 in Table 1 may contain up to 150 ppm C, 0–100 ppm Y, 0–10 ppm La and upto 5 ppm S.

BRIEF DESCRIPTION OF THE DRAWINGS

The present invention will be more fully described by way of example with reference to the accompanying drawings, in which.

Figure 1:
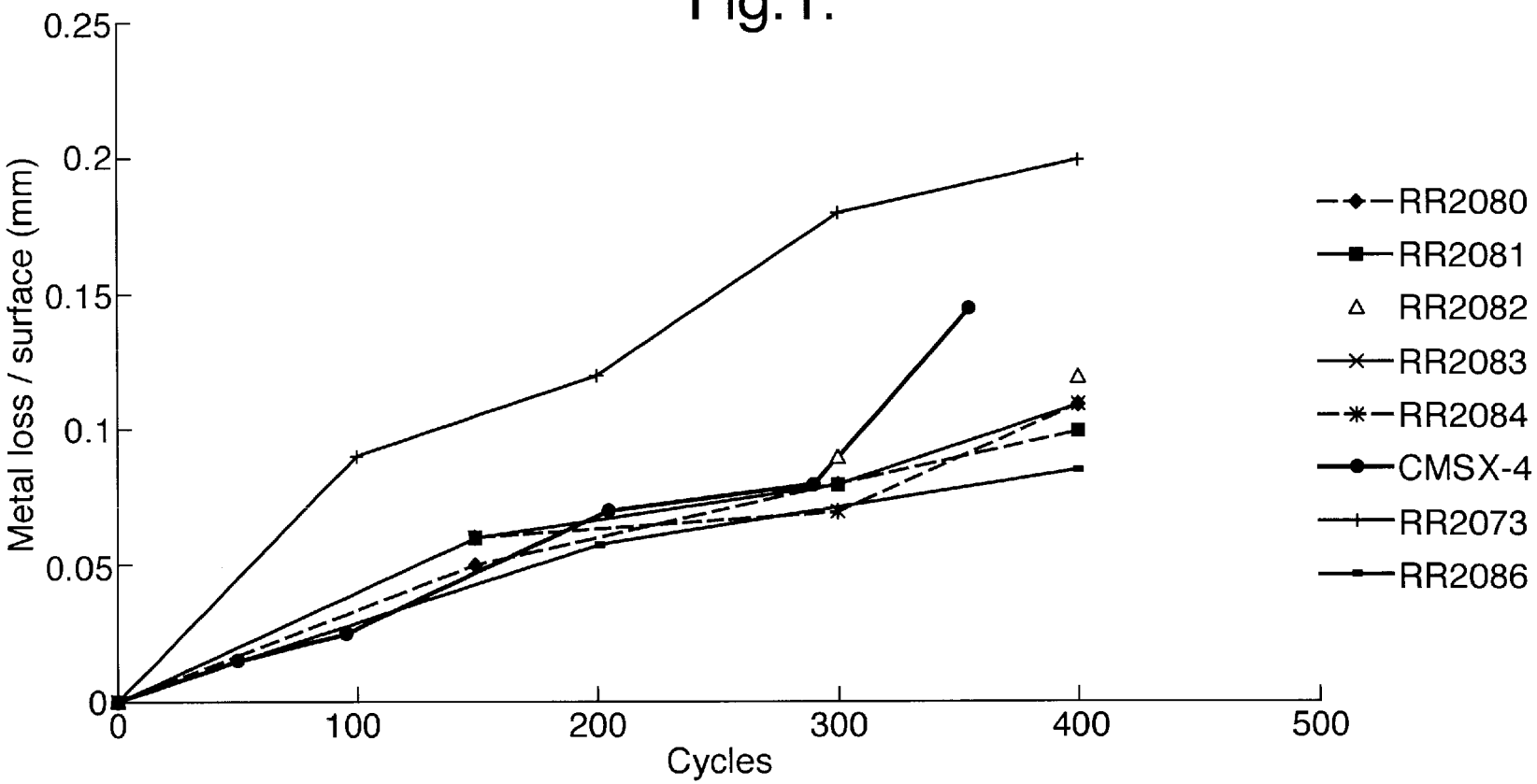
FIG. 1 is a graph comparing high temperature oxidation resistance at 1100° C. for various nickel based single crystal superalloys.

The superalloys in Table 1 were initially tested for compatibility with a known thermal barrier coating system by depositing about 8 $\mu$m of platinum onto the samples of the 40 superalloy substrate and heat treating at 1150° C. to form a layer comprising platinum enriched gamma phase and platinum enriched gamma prime phase. This layer together with a layer of alumina which forms on the layer becomes a bond coating for a ceramic thermal barrier coating deposited by electron beam physical vapour deposition.

The samples of the superalloys with the bond coatings and ceramic thermal barrier coatings were isothermally soaked for 25 hours at specific temperatures, and the temperature at which the ceramic thermal barrier coating spalled was noted and the highest temperature at which the ceramic thermal barrier coating did not spall was noted. The temperature above which the ceramic thermal barrier coating spalls is a measure of the compatibility between the superalloy substrate and the ceramic thermal barrier coating. The levels of sulphur and titanium and the highest temperature at which the ceramic thermal barrier coating did not spall are shown in Table 2.

TABLE 2

| Alloy | Ti (wt %) | S (ppm) | Temperature of TBC spallation (° C.) |
|---|---|---|---|
| CMSX4 | 1.0 | <2 | 1190 |
| CMSX10 | 0.2 | <2 | 1250 |
| 2072 | 0.4/0.45 | 10 | 1230 |
| 2073 | 0.3 | <20 | 1210 |
| 2074 | 0.4/0.45 | <10 | 1190 |
| 2075 | 0.4/0.45 | 6 | 1210 |
| 2076 | 0.4/0.45 | 10 | 1230 |
| 2077 | 0.4/0.45 | 16 | 1170 |
| 2078 | 0.4/0.45 | 9 | 1230 |
| 2079 | 0 | 7 | 1230 |
| 2080 | 0 | 2–3 | 1210 |
| 2081 | 0 | 2–3 | 1210 |
| 2082 | 0 | 2–3 | 1210 |
| 2083 | 0 | 2–3 | 1210 |
| 2084 | 0 | 2–3 | 1230 |
| 2085 | 0 | <5 | 1210 |
| 2086 | 0 | <5 | 1190 |
| 2087 | 0 | <5 | 1190 |

It can be seen that low sulphur levels in the superalloy are beneficial for compatibility with the ceramic thermal barrier coating, see for example superalloy 2077 which has 16 ppm sulphur and this loses it's ceramic thermal barrier coating above 1170° C. High levels of rhenium in the superalloy are beneficial for compatibility with the ceramic thermal barrier coating, see for example CMSX10 which has 6.2 wt % rhenium loses it's ceramic thermal barrier coating above 1250° C. and superalloy 2084 which has 3.4 wt % rhenium loses it's ceramic thermal barrier coating above 1230° C. is much better than superalloys 2080 to 2083 which have 3.0 wt % rhenium and which lose their ceramic thermal barrier coatings above 1210° C. Low, preferably zero, levels of titanium in the superalloy are beneficial for compatibility with the ceramic thermal barrier coating, see for example CMSX10 which has 0.20 wt %a titanium and superalloy 2079 and 2084 which have zero titanium lose their ceramic thermal barrier coatings above 1230° C. and CMSX4 which has 1.0 two titanium and low sulphur level loses it's ceramic thermal barrier coating above 1190° C. Low levels of cobalt are beneficial for compatibility with the ceramic thermal barrier coating, see for example the alloy sequence 2084, 2085 and 2086, in which the alloys have the same composition apart from a progressive increase in cobalt level from 4 wt % to 10 wt %. The spallation temperature decreased progressively from 1230° C. to 1190° C. in that sequence.

In summary for compatibility with the ceramic thermal barrier coating the superalloy should have as low a level of sulphur as possible, preferably less than 5 ppm, preferably zero, but his depends on the purity of the raw materials. The superalloy should have zero titanium. The superalloy should have as high a rhenium level as possible, but this is limited by the density and cost requirements. The superalloy should have a low cobalt level, around 4 wt %, unless the requirement for metallurgical stability is paramount, in which case a high cobalt level, around 10 wt %, is preferred.

In order to achieve lower density the level of tungsten is reduced and the level of molybdenum has increased, the level of tantalum is reduced and the level of niobium is increased and the level of titanium is reduced to 0 and the level of aluminum is increased as seen in Table 1. This produced a reduction in the density of the superalloy to 8.5 to 8.6 gm per $cm^3$ from 8.7 to 8.9 gm per $cm^3$ of existing second generation nickel based single crystal superalloys.

The requirement for high temperature oxidation resistance is essentially the same as the requirement for compatibility with ceramic thermal barrier coatings, but with the requirement for high levels of aluminum. Additionally yttrium and/or lanthanum may be added at up to 100 parts per million to improve oxidation resistance.

The requirement for stability of the superalloy is achieved by setting the cobalt level to 9–11 wt %, because it is believed that this level of cobalt in a second generation nickel based single crystal superalloy suppresses the formation of topologically close packed (TCP) phases. However, if the requirement for thermal barrier compatibility is paramount, a low cobalt level, around 4 wt % is preferred.

The requirement for high temperature creep strength, greater than 1100° C. is achieved by producing a stable set of gamma prime phase plates perpendicular to the stress direction. This requires a negative gamma phase/gamma prime phase mismatch at the operating temperature, and the mismatch becomes more negative as the temperature increases. The mismatch was set at 0–0.1% at room temperature, this is less than the 0.17% mismatch of CMSX4. A practical superalloy requires good creep strength across the temperature range 850° C.–1050° C. as well as greater than 1100° C. The creep strength in the temperature range 850° C.–1050° C. is controlled by the composition of the gamma phase, the width of the gamma phase channels between the gamma prime phase particles, the gamma phase/gamma prime phase mismatch and the strength of the gamma prime phase. The gamma phase/gamma prime phase mismatch is already fixed and the gamma phase channel width is controlled by the volume fraction of gamma prime phase, aiming to be about 65%.

The requirement for corrosion resistance is not as critical as other properties because superalloys a generally provided with protective coatings. However to provide some corrosion resistance chromium is provided, but chromium has the detrimental effect of promoting the formation of the sigma phase, however slightly lower chromium levels may be tolerated if the rhenium level is higher. Hence the rhenium level is increased to about 3.4 wt %.

The requirement for freckling resistance is important in the castability of the superalloy. Freckles are small chains of equiaxed grains that form during the solidification of the single crystal superalloy. Freckles form because of differences in density between the solid and liquid phases in the mushy zone, the density gradient produces currents in the liquid phase which break off pieces of dendrite. The pieces of dendrite promote the nucleation of separate grains. Freckling is controlled by having sufficient heavy gamma prime phase forming elements such as tantalum to balance the heavy gamma phase forming elements such as tungsten and rhenium. A simple empirical formula to avoid freckling is:

$$\frac{Ta}{W + Re}$$

is greater than or equal to 0.8. A more complex empirical formula to avoid freckling is 30 defined in published International patent application No WO97/48827A:

$$\frac{Ta + (1.5 \times Hf) + (0.5 \times Mo) - (0.5 \times Ti)}{W + (1.2 \times Re)}$$

is greater than 0.7, pref 1.0 The above two formulas use wt %. The superalloys of the present invention have a parameter of 0.95 for the latter formula and this should give little freckling. Oxide inclusions may promote the formation of defects in single crystal superalloy castings. The requirement for alloy cleanliness is achieved by adding carbon because it is known that corrosion reduces the level of deleterious oxides inclusions in the single crystal superalloy. The carbon may also provide some grain boundary strength. However, too much carbon promotes script carbides which reduce the fatigue strength of the superalloy. Therefore carbon up to 150 ppm, preferably 100 ppm, may be added to clean the superalloy without any significant effect on the fatigue strength.

Cyclic oxidation testing has been performed on a burner rig, the cycling rate was 4 cycles per hour and 0.25 ppm of simulated sea salt was added to the gas flow to simulate operation in a marine environment. The measure of the amount of attack on the superalloy is by metal loss per surface and thedata is shown in FIG. 1 for testing at a temperature of 1100° C. for superalloys 2073, 2080–2084, 2086 and CMSX4. It can be seen that superalloys 2080–2084 and 2086 have similar oxidation resistance to CMSX4. In fact the preferred superalloy 2086 has the best oxidation resistance of the series.

Figure 2:
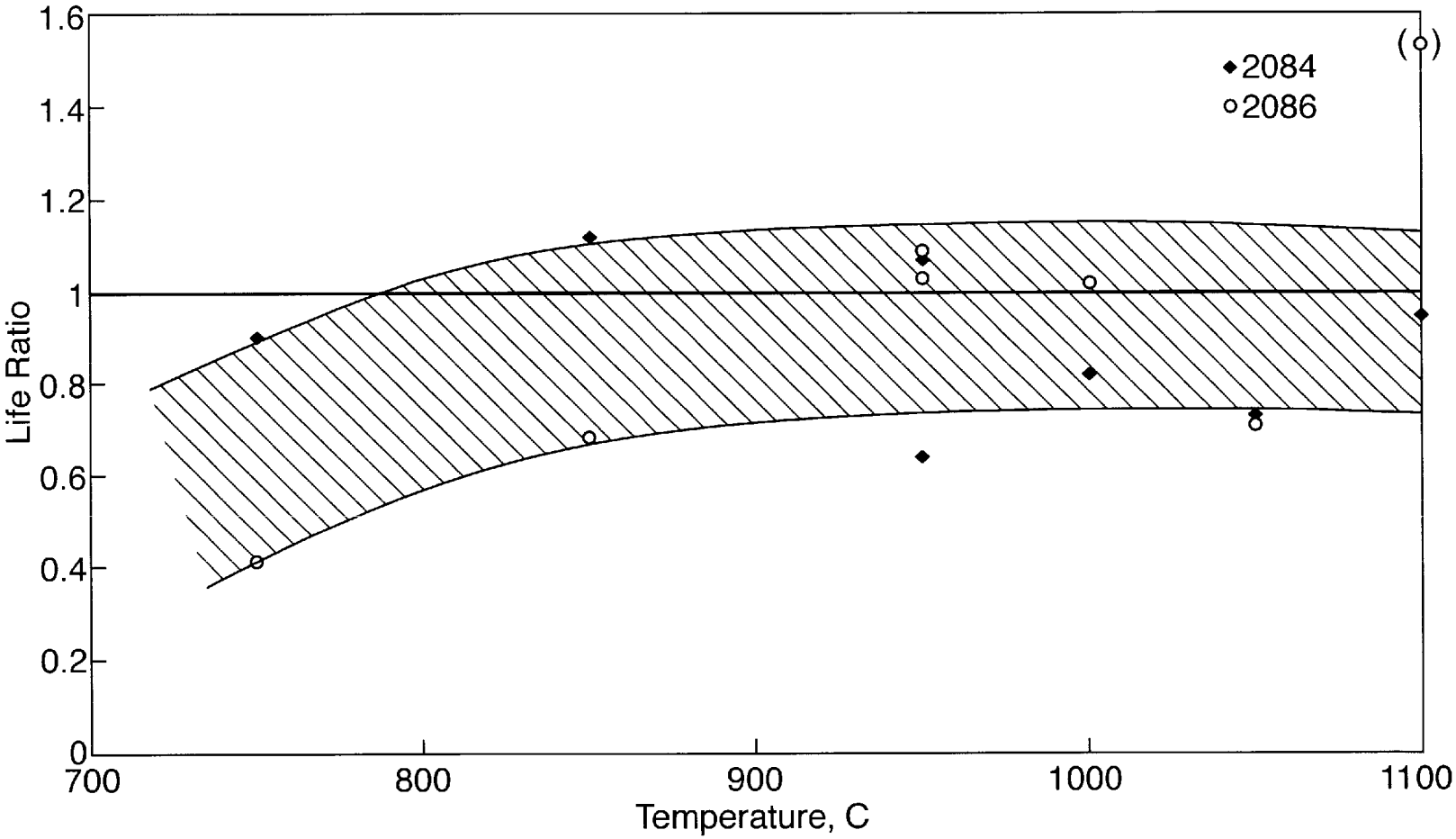
FIG. 2 is a graph showing the ratio of time of 1% creep strain between two nickel based single crystal superalloys and CMSX4 against temperature.

The creep performance can be expressed as the time to 1% creep strain under various conditions of stress and temperature. These times for the superalloys 2084 and 2086 are listed in Table 3, and a comparison is made with the creep properties of CMSX4 in FIG. 2. The vertical axis of this graph is the ratio of creep lives between superalloys 2084 or 2086 of the present invention and CMSX4. The general trend is for the superalloys of the present invention to be worse than CMSX4 at temperatures below 850° C., and equivalent to CMSX4 at temperatures above 850° C. up to 1100° C., the highest temperature at which tests were performed.

TABLE 3

| Test Temperature | Stress | Time to 1% Strain (hrs) | |
|---|---|---|---|
| (° C.) | (Mpa) | 2084 | 2086 |
| 750 | 720 | 5 | 2.3 |
| 850 | 430 | 785 | 480 |
| 900 | 290 | 139 | 142 |
| 950 | 210 | 517 | 829 |
| 1000 | 165 | 410 | 514 |
| 1050 | 165 | 91 | 89 |
| 1100 | 115 | 152 | 251 |

The main advantage of the nickel based single crystal superalloys according to the present invention compared to current second generation nickel based single crystal superalloys is that the superalloys of the present invention have improved compatibility with ceramic thermal barrier coatings such that the bond coating temperature may be increased by 20° ,C.–40° C. for a given life. Another advantage of the nickel based single crystal superalloys according to the present invention compared to current second generation nickel based single crystal superalloys is that the superalloys of the present invention have lower density reducing the weight of the component, turbine blade or turbine vane, with consequential reduction in weight of the turbine disc. Another advantage of the nickel based single crystal superalloys according to the present invention compared to current second generation nickel based single crystal superalloys is that the superalloys of the present invention have improved resistance to freckling and to the formation of stray grains, this enables thicker sections to be cast successfully. Additionally the nickel based single crystal superalloys according to the present invention have similar high temperature high temperature oxidation resistance and creep strength compared to current second generation nickel based single crystal superalloys.

Other suitable bond coatings may be used on the nickel based single crystal superalloy article, for example McrAlY, aluminide, platinum aluminide etc. the ceramic thermal barrier coatings may be deposited by other suitable methods for example sputtering, vacuum plasma spraying, air plasma spraying, chemical vapor deposition etc. the ceramic thermal barrier coatings may comprise yttrium stabilized zirconia, ceria stabilized zirconia or other suitable ceramics.

We claim:

1. A nickel based single crystal superalloy comprising 3–11 wt % cobalt, 4.7–5.7 wt % Chromium, 2.4–3.0 wt % molybdenum, 3.0–3.8 wt % tungsten, 3.0–3.8 wt % rhenium, 5.5–7.0 wt % aluminum, 5.0–6.0 wt % tantalum, 0.5–1.0 wt % niobium, 0–0.2 wt % hafnium, 0–150 ppm carbon, 0–100 ppm yttrium, 0–100 ppm lanthanum, 0–5 ppm sulfur and the balance nickel plus incidental impurities.

2. A cast single crystal nickel based superalloy article, the superalloy of the article comprising 3–11 wt % cobalt, 4.7–5.7 wt % chromium, 2.4–3.0 wt % molybdenum, 3.0–3.8 wt % tungsten, 3.0–3.8 wt % rhenium, 5.5–7.0 wt % aluminum, 5.0–6.0 wt % tantalum, 0.5–1.0 wt % niobium, 0–0.2 wt % hafnium, 0–150 ppm carbon, 0–100 ppm yttrium, 0–100 ppm lanthanum, 0–5 ppm sulfur and the balance nickel plus incidental impurities.

3. A cast single crystal nickel based superalloy article as claimed in claim 2 wherein the article comprises a turbine blade, a turbine vane or a combustor component.

4. A cast single crystal nickel based superalloy article as claimed in claim 3 wherein the article comprises at least one internal passage for the flow of cooling fluid.

5. A cast single crystal nickel based superalloy article as claimed in claim 3 wherein the article comprises a bond coating on the article and a ceramic thermal barrier coating on the bond coating.

6. A cast single crystal nickel based superalloy article as claimed in claim 5 wherein the bond coating comprises a layer of alumina.

7. A cast single crystal nickel based superalloy article as claimed in claim 5 wherein the bond coating comprises a layer comprising a platinum enriched gamma prime phase and a platinum enriched gamma phase.

8. A nickel based single crystal superalloy comprising 0–11 wt % cobalt, 5.1–5.4 wt % chromium, 2.6–2.9 wt % molybdenum, 3.2–3.5 wt % tungsten, 3.2–3.5 wt % rhenium, 6.05–6.3 wt % aluminum, 5.4–5.7 wt % tantalum, 0.7–0.9 wt % niobium, 0.07–0.12 wt % hafnium, 50–150 ppm carbon, 0–100 ppm yttrium, 0–100 ppm lanthanum, 0–5 ppm sulfur and the balance nickel plus incidental impurities.

9. A nickel based single crystal to superalloy as claimed in claim 8 comprising 10 wt % cobalt, 5.2 wt % chromium, 2.7 wt % molybdenum, 3.35 wt % tungsten, 3.4 wt % rhenium, 6.2 wt % aluminum, 5.5 wt % tantalum, 0.8 wt % niobium, 0.1 wt % hafnium, 0–100 ppm yttrium, 0–100 pm lanthanum, 0–5 ppm sulfur and the balance nickel plus incidental impurities.

10. A nickel based single crystal superalloy comprising 3–5 wt % cobalt, 5.1–5.4 wt % chromium, 2.6–2.9 wt % molybdenum, 3.2–3.5 wt % tungsten, 3.2–3.5 wt % rhenium, 6.05–6.3 wt % aluminum, 5.4–5.7 wt % tantalum, 0.7–0.9 wt % niobium, 0.07–0.12 wt % hafnium, 50–150 ppm carbon, 0–100 ppm yttrium, 0–100 ppm lanthanum, 0–5 ppm sulfur and the balance nickel plug incidental impurities.

11. A nickel based single crystal superalloy as claimed in claim 10 comprising 4 wt % cobalt, 5.2 wt % chromium, 2.7 wt % molybdenum, 3.35 wt % tungsten, 3.4 wt % rhenium, 6.2 wt % aluminum, 5.5 wt % tantalum, 0.8 wt % niobium, 0.1 wt % hafnium, 0–100 ppm yttrium, 0–100 ppm lanthanum, 0–5 ppm sulfur and the balance nickel plus incidental impurities.

12. A cast single crystal nickel based superalloy article comprising 9–11 wt % cobalt, 5.1–5.4 wt % chromium, 2.6–2.9 wt % molybdenum, 3.2–3.5 wt % tungsten, 3.2–3.5 wt % rhenium, 6.05–6.3 wt % aluminum, 5.4–5.7 wt % tantalum, 0.7–0.9 wt % niobium, 0.07–0.12 wt % hafnium, 50–150 ppm carbon, 0–100 ppm yttrium, 0–100 ppm lanthanum, 0–5 ppm sulfur and the balance nickel plus incidental impurities.

13. A cast single crystal nickel based superalloy article as claimed in claim 12 comprising 10 wt % cobalt, 5.2 wt % chromium, 2.7 wt % molybdenum, them 3.35 wt % tungsten, 3.4 wt % rhenium, 6.2 wt % aluminum, 5.5 wt % tantalum, 0.8 wt % niobium, 0.1 wt % hafnium, 0–100 ppm yttrium, 0–100 pm lanthanum, 0–5 ppm sulfur and the balance nickel plus incidental impurities.

14. A cast single crystal nickel based superalloy article comprising 3–5 wt % cobalt, 5.1–5.4 wt % chromium, 2.6–2.9 wt % molybdenum, 3.2–3.5 wt % tungsten, 3.2–3.5 wt % rhenium, 6.05–6.3 wt % aluminum, 5.4–5.7 wt % tantalum, 0.7–0.9 wt % niobium, 0.07–0.12 wt % hafnium, 50–150 ppm carbon, 0–100 ppm yttrium, 0–100 ppm lanthanum, 0–5 ppm sulfur and the balance nickel plus incidental impurities.

15. A cast single crystal nickel based superalloy article as claimed in claim 14 comprising 4 wt % cobalt, 5.2 wt % chromium, 2.7 wt % molybdenum, 3.35 wt % tungsten, 3.4 wt % rhenium, 6.2 wt % aluminum, 5.5 wt % tantalum, 0.8 wt % niobium, 0.1 wt % hafnium, 0–100 ppm yttrium, 0–100 ppm lanthanum, 0–5 ppm sulfur and the balance nickel plus incidental impurities.

* * * * *